US008732980B2

(12) United States Patent
Napfel et al.

(10) Patent No.: US 8,732,980 B2
(45) Date of Patent: May 27, 2014

(54) DRIER MODULE FOR A DRIER

(75) Inventors: Peter Napfel, Tamm (DE); Helmuth Zurich, Ochtrup (DE); Andreas Gerber, Ottersweiler (DE)

(73) Assignee: Dürr Systems GmbH, Bietigheim-Bissingen (DE)

( * ) Notice: Subject to any disclaimer, the term of this patent is extended or adjusted under 35 U.S.C. 154(b) by 703 days.

(21) Appl. No.: 12/345,506

(22) Filed: Dec. 29, 2008

(65) Prior Publication Data

US 2009/0172966 A1 Jul. 9, 2009

Related U.S. Application Data

(63) Continuation of application No. PCT/EP2007/005117, filed on Jun. 9, 2007.

(30) Foreign Application Priority Data

Jun. 30, 2006 (DE) ..... 10 2006 030 334

(51) Int. Cl.

| | |
|---|---|
| ***F26B 19/00*** | (2006.01) |
| ***F26B 3/34*** | (2006.01) |
| ***E04H 5/00*** | (2006.01) |
| ***E04B 1/74*** | (2006.01) |
| ***E04B 1/61*** | (2006.01) |
| ***E04B 2/00*** | (2006.01) |

(52) U.S. Cl.
USPC ..... 34/666; 34/270; 34/216; 52/79.5; 52/404.4; 52/127.6; 52/437

(58) Field of Classification Search
USPC ..... 34/622, 216, 666, 270; 52/745.11, 52/745.14, 79.5, 79.9, 127.6, 271, 375, 52/404.4, 436, 437, 570, 582.2
See application file for complete search history.

(56) References Cited

U.S. PATENT DOCUMENTS

| | | | |
|---|---|---|---|
| 1,927,634 | A | 9/1933 | Fahrenwald |
| 1,992,467 | A | 2/1935 | Blythe |

(Continued)

FOREIGN PATENT DOCUMENTS

| | | |
|---|---|---|
| CH | 254872 A | 5/1948 |
| DE | 47 113 | 5/1889 |

(Continued)

OTHER PUBLICATIONS

European Patent Office, First Examination Report in European Patent Application No. 07725941.4 (Feb. 17, 2012).

*Primary Examiner* — Kenneth Rinehart
*Assistant Examiner* — John McCormack
(74) *Attorney, Agent, or Firm* — Leydig, Voit & Mayer, Ltd.

(57) ABSTRACT

In order to provide a drier module for a drier for a coating plant, in particular for a coating plant for vehicle bodies, wherein the drier comprises a drier working space for receiving the objects to be dried, which space is bounded by a drier floor, a drier ceiling and lateral boundary walls, which reduces the transport costs for transporting the drier components from the production site to the erection site, it is proposed that the drier module comprise at least one section of a lateral boundary wall of the drier working space and one section of the drier floor and/or one section of the drier ceiling, wherein the drier floor section and/or the drier ceiling section are/is connected to the boundary wall section so as to be pivotable relative to the boundary wall section.

12 Claims, 6 Drawing Sheets

(56) References Cited

U.S. PATENT DOCUMENTS

| | | | | | |
|---|---|---|---|---|---|
| 2,077,189 | A | | 4/1937 | Rishel | |
| 2,105,973 | A | | 1/1938 | Hereford | |
| 2,797,006 | A | | 6/1957 | Thompson | |
| 2,818,156 | A | | 12/1957 | Edwards | |
| 2,890,802 | A | | 6/1959 | Alimanestiano | |
| 3,204,785 | A | | 9/1965 | Bajulaz | |
| 3,402,481 | A | | 9/1968 | LaPan | |
| 3,433,236 | A | | 3/1969 | Koch et al. | |
| 3,953,947 | A | * | 5/1976 | Hendrich | 52/70 |
| 3,968,559 | A | | 7/1976 | Karlsson | |
| 4,248,341 | A | | 2/1981 | Schuck et al. | |
| 4,343,395 | A | | 8/1982 | Lippert et al. | |
| 4,564,100 | A | | 1/1986 | Moon | |
| 4,620,373 | A | | 11/1986 | Laskowski et al. | |
| 4,774,773 | A | | 10/1988 | Zwyssig | |
| 4,894,909 | A | | 1/1990 | Sakamoto et al. | |
| 4,901,845 | A | | 2/1990 | Zorgiebel | |
| 4,951,802 | A | | 8/1990 | Weissgerber et al. | |
| 5,037,263 | A | | 8/1991 | Yamashita | |
| 5,060,426 | A | * | 10/1991 | Jantzen | 52/86 |
| 5,116,182 | A | | 5/1992 | Lin | |
| 5,217,374 | A | | 6/1993 | Birks | |
| 5,242,045 | A | | 9/1993 | Kakida et al. | |
| 5,263,267 | A | | 11/1993 | Buttner et al. | |
| 5,473,845 | A | * | 12/1995 | Livingston et al. | 52/79.9 |
| 5,494,561 | A | | 2/1996 | Darche et al. | |
| 5,553,988 | A | | 9/1996 | Horn et al. | |
| 5,556,466 | A | | 9/1996 | Martin et al. | |
| 5,661,912 | A | | 9/1997 | Bhatnagar et al. | |
| 5,873,165 | A | | 2/1999 | Bode et al. | |
| 5,890,341 | A | * | 4/1999 | Bridges et al. | 52/745.2 |
| 6,197,175 | B1 | | 3/2001 | Kisi et al. | |
| 6,269,941 | B1 | | 8/2001 | Ueno | |
| 6,455,817 | B1 | | 9/2002 | Guzzi et al. | |
| 6,557,268 | B1 | | 5/2003 | Berg et al. | |
| 6,990,749 | B2 | | 1/2006 | Roesler et al. | |
| 2001/0030108 | A1 | | 10/2001 | Hansen | |
| 2003/0042113 | A1 | | 3/2003 | Kasagi | |
| 2004/0032061 | A1 | | 2/2004 | Sachse et al. | |
| 2005/0194234 | A1 | | 9/2005 | Schmohl et al. | |
| 2007/0261264 | A1 | | 11/2007 | Ortlieb et al. | |
| 2007/0261953 | A1 | | 11/2007 | Kohler et al. | |
| 2008/0209820 | A1 | * | 9/2008 | Muir | 52/71 |

FOREIGN PATENT DOCUMENTS

| | | | |
|---|---|---|---|
| DE | 1 754 378 | U | 10/1957 |
| DE | 1 060 420 | | 7/1959 |
| DE | 2031105 | A | 1/1971 |
| DE | 2130610 | A1 | 12/1972 |
| DE | 2245991 | A1 | 7/1974 |
| DE | 2451056 | A1 | 5/1976 |
| DE | 2031105 | B2 | 5/1979 |
| DE | 2031105 | C3 | 1/1980 |
| DE | 28 38 974 | C2 | 3/1980 |
| DE | 8321727 | U1 | 12/1983 |
| DE | 3439860 | A1 | 3/1986 |
| DE | 3439860 | C2 | 10/1987 |
| DE | 40 07 707 | A1 | 9/1990 |
| DE | 40 41 211 | C1 | 1/1992 |
| DE | 42 33 970 | C2 | 9/1993 |
| DE | 42 22 | A1 | 1/1994 |
| DE | 44 30 882 | A1 | 3/1996 |
| DE | 198 39 725 | C1 | 3/2000 |
| DE | 199 36 879 | C1 | 9/2000 |
| DE | 199 42 556 | A1 | 3/2001 |
| DE | 199 50 202 | C2 | 5/2001 |
| DE | 201 04 205 | U1 | 7/2001 |
| DE | 20104205 | U1 | 8/2001 |
| DE | 101 62 084 | A1 | 6/2002 |
| DE | 203 04 601 | U1 | 6/2003 |
| DE | 202 11 083 | U1 | 8/2003 |
| DE | 10238493 | A1 | 3/2004 |
| DE | 103 25 656 | B3 | 7/2004 |
| DE | 102004008812 | A1 | 9/2005 |
| DE | 102004011254 | A1 | 9/2005 |
| DE | 102004056404 | A1 * | 5/2006 |
| DE | 102004061791 | A1 | 7/2006 |
| DE | 202004021146 | U1 | 12/2006 |
| EP | 0 149 694 | A1 | 7/1985 |
| EP | 0 255 620 | A2 | 2/1988 |
| EP | 0 436 081 | A1 | 7/1991 |
| EP | 0581687 | A1 | 2/1994 |
| EP | 0 649 919 | B1 | 4/1995 |
| EP | 1055895 | A1 | 11/2000 |
| EP | 1 424 | A2 | 6/2004 |
| EP | 1 510 477 | A1 | 3/2005 |
| EP | 1 840 037 | A1 | 10/2007 |
| FR | 1 076 870 | | 5/1953 |
| FR | 2756815 | A | 6/1998 |
| FR | 2 785 884 | A1 | 5/2000 |
| GB | 120809 | A | 11/1918 |
| GB | 462838 | A | 3/1937 |
| GB | 844309 | | 8/1960 |
| GB | 1 203 789 | A | 9/1970 |
| GB | 1310971 | A | 3/1973 |
| JP | 03-159886 | | 7/1991 |
| JP | 03-186510 | | 8/1991 |
| JP | 8-246194 | A | 9/1996 |
| WO | WO 99/04209 | A1 | 1/1999 |
| WO | WO 02/047894 | A1 | 6/2002 |
| WO | WO 2004/018333 | A1 | 3/2004 |
| WO | WO 2004/081476 | A1 | 9/2004 |
| WO | WO 2004/081476 | B1 | 1/2005 |
| WO | WO 2006/056318 | A1 | 6/2006 |
| WO | WO 2006/066920 | A1 | 6/2006 |

* cited by examiner

DRIER MODULE FOR A DRIER

RELATED APPLICATION

This application is a continuation application of PCT/EP2007/005117 filed Jun. 9, 2007, the entire specification of which is incorporated herein by reference.

FIELD OF THE DISCLOSURE

The present invention relates to the technical field of driers for a coating plant, in particular for a coating plant for vehicle bodies, wherein the drier comprises a drier working space for receiving the objects to be dried, which space is bounded by a drier floor, a drier ceiling and lateral boundary walls.

BACKGROUND

A drier of this kind is known from DE 201 04 205 U1, for example.

Known driers of this kind are assembled at the erection site of the drier from drier segments which are of the full cross section of the drier and are assembled at a production site remote from the erection site of the drier. The transport of these drier segments from the production site to the erection site of the drier entails considerable transport costs.

SUMMARY OF THE INVENTION

The object of the present invention is to reduce the transport costs for transporting the drier components from the production site to the erection site.

This object is solved according to the invention by a drier module which comprises at least one section of a lateral boundary wall of the drier working space and one section of the drier floor and/or one section of the drier ceiling, wherein the drier floor section and/or the drier ceiling section are/is connected to the boundary wall section so as to be pivotable relative to the boundary wall section.

A drier module of this kind can be brought into a folded state, in which the drier module only occupies a small floor space and can be transported in a space-saving manner, for transport from the production site to the erection site of the drier.

At the erection site of the drier the drier can then be transferred from the folded state to an unfolded state, in which the drier floor section or the drier ceiling section occupies the same position relative to the boundary wall section as in the finished drier.

Two drier modules placed opposite one another in the unfolded state at the erection site of the drier can then be pushed together so that together they form a drier segment which is of the full cross section of the drier which is to be produced.

The transport costs for transporting the drier components from the production site to the erection site of the drier are therefore substantially reduced by the drier module according to the invention.

Moreover, by using drier modules of this kind, the time for assembling the drier at the erection site is considerably reduced when compared with assembly from individual components, as the lateral boundary walls of the drier working space are already connected to a respective drier floor section or to a respective drier ceiling section.

In one preferred configuration of the invention the drier floor section and/or the drier ceiling section of the drier module are/is connected to the boundary wall section by means of at least one hinge.

The drier floor section or the drier ceiling section can in this respect be pivotably held directly on the boundary wall section or connected indirectly to the boundary wall section by being pivotably held on another component of the drier module which in turn is connected, preferably rigidly, to the boundary wall section of the drier module.

Generally speaking, the drier floor section or the drier ceiling section of a drier module could extend only over a part of the width of the drier working space.

However it is particularly favourable for the drier floor section and/or the drier ceiling section of the drier module to extend over substantially the entire width of the drier working space. In this case just one single drier module is required in order to form the entire drier floor or the entire drier ceiling of a drier segment.

The drier module can be transported in a particularly space-saving manner when it can be brought into a folded state, in which the drier floor section and/or the drier ceiling section extend(s) substantially parallel to the boundary wall section of the drier module.

Generally speaking, the drier module according to the invention can be used for driers of any desired design and mode of operation.

In one preferred configuration of the invention, however, the drier module is the drier module for a hot air drier, wherein the hot air drier comprises at least one air supply duct through which drier supply air to be supplied to the drier working space can flow, and wherein the drier module comprises a section of an air supply duct, wherein the drier floor section and/or the drier ceiling section of the drier module are/is connected to the section of the air supply duct so as to be pivotable relative to the section of the air supply duct.

The drier floor section or the drier ceiling section can in this respect be pivotably held directly on the section of the air supply duct.

However, as an alternative to this, it is also conceivable for the drier floor section or the drier ceiling section to be pivotably held on another component of the drier module which in turn is connected, preferably substantially rigidly, to the section of the air supply duct.

Claim 6 is directed towards a combination of two drier modules according to the invention, wherein a first drier module comprises a drier floor section and a second drier module comprises a drier ceiling section.

A complete segment of the drier with drier floor and drier ceiling can then be assembled from two drier modules of this kind.

A combination of this kind of two drier modules preferably also comprises a transport container which receives both drier modules. The two drier modules, preferably in the folded state, can be transported in a particularly space-saving manner in a transport container of this kind.

At least one of the drier modules is preferably received by the transport container in a folded state, in which the drier floor section or the drier ceiling section of the drier module concerned extends substantially parallel to the boundary wall section of the drier module concerned.

Claim 9 is directed towards a drier for a coating plant, in particular for a coating plant for vehicle bodies, which comprises a drier working space for receiving the objects to be dried, wherein the drier working space is bounded by a drier floor, a drier ceiling and at least one lateral boundary wall, wherein the drier comprises at least one drier module according to the invention.

It is in particular possible for a drier of this kind to comprise at least one first drier module which comprises a drier floor section, and at least one second drier module which comprises a drier ceiling section, wherein the drier floor section of the first drier module is fixed to the second drier module and/or the drier ceiling section of the second drier module is fixed to the first drier module, preferably in a substantially gastight manner.

In this respect the first drier module and the second drier module can in particular be welded together.

The drier according to the invention is preferably formed as a hot air drier which comprises at least one air supply duct through which air to be supplied to the drier working space flows.

In this case it is of advantage for the drier to comprise at least one drier module which comprises a section of an air supply duct. In this case the advantages of the space-saving and transportable drier modules can be used for the construction of the complete drier, including the air supply ducts.

In one preferred configuration of a drier of this kind the drier comprises at least one drier module which has a drier floor section which is fixed to the floor of an air supply duct section of another drier module, preferably in a substantially gastight manner.

Alternatively or additionally to this, the drier can comprise at least one drier module which has a drier ceiling section which is fixed to a ceiling of a supply duct section of another drier module, preferably in a gastight manner.

It is particularly favourable for the drier to comprise at least two drier modules which are welded together.

The drier can in particular comprise at least two drier modules which together form a drier segment extending in a longitudinal direction of the drier.

In this case the drier can have a plurality of drier segments which follow one another in the longitudinal direction and are in each case composed of at least two drier modules.

In one preferred configuration of the invention the drier comprises a conveyor device for conveying the objects to be dried along a conveying direction through the drier working space.

Further features and advantages of the invention constitute the subject matter of the following description and the graphic representation of an embodiment.

BRIEF DESCRIPTION OF THE DRAWINGS

The same or functionally equivalent elements are designated with the same reference characters in all the figures.

DETAILED DESCRIPTION OF THE INVENTION

Figure 7:
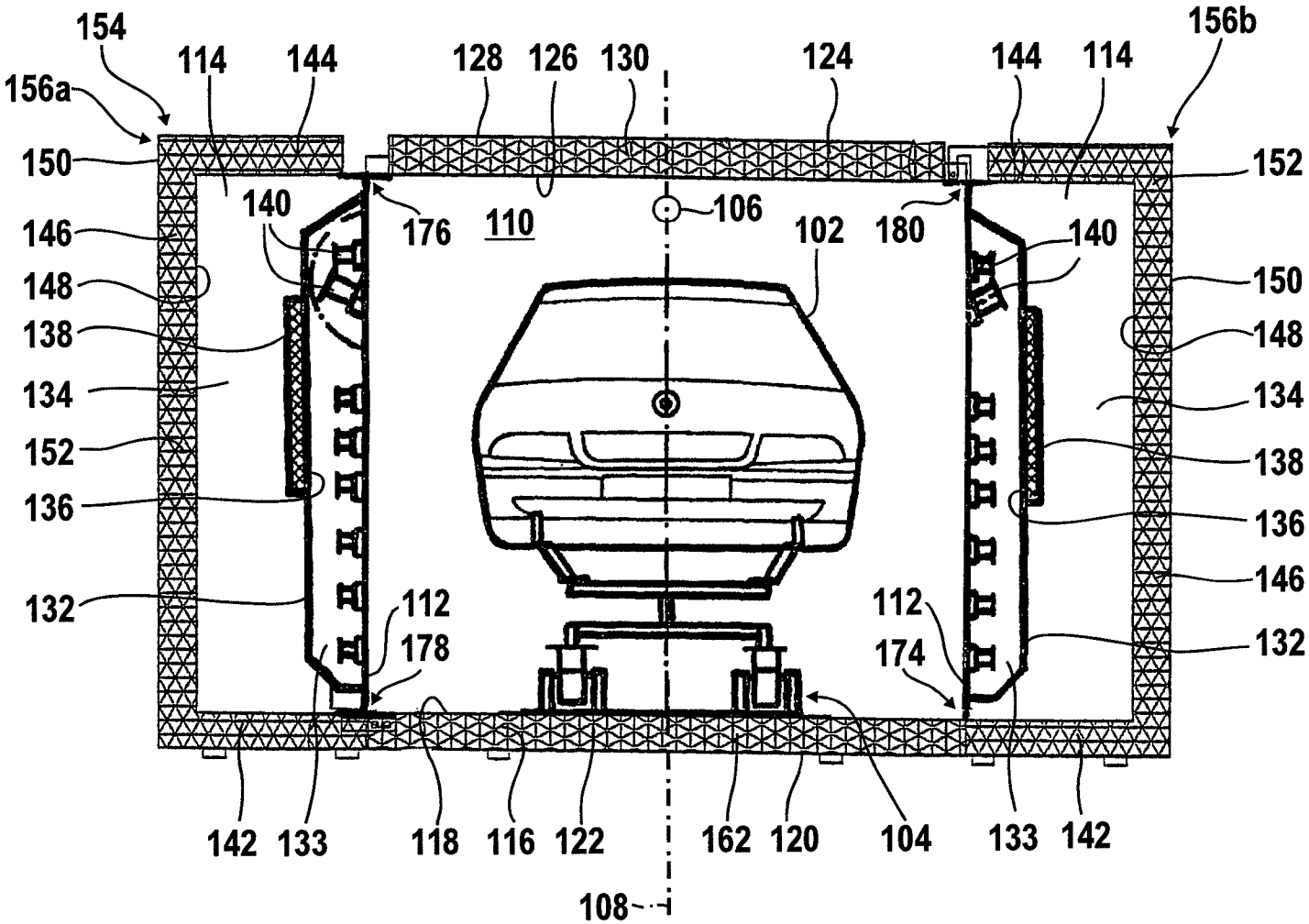
FIG. 7 is a schematic vertical section through the hot air drier from FIG. 4 with a vehicle body conveyed through the drier working space of the hot air drier and a conveyor device for conveying the vehicle body through the drier working space.

A hot air drier which is shown as a whole and designated by 100 in FIG. 7 serves to dry a surface coating of vehicle bodies 102 which are provided with a surface coating, in particular a varnish coating, in a coating application section, disposed before the hot air drier 100, of a coating plant and then conveyed along a conveying direction 106 through the hot air drier 100 by means of a conveyor device 104, for example by means of an inverted endless conveyor.

The hot air drier 100 is formed substantially symmetrically relative to its longitudinal centre plane 108 and comprises a central tunnel-like drier working space 110 which has a substantially rectangular cross section, extends along the conveying direction 106 and is separated on both sides from a respective laterally disposed air supply duct 114 by a respective vertical lateral boundary wall 112.

At the bottom the drier working space 110 is bounded by a drier floor 116 which comprises an inner wall 118 facing the drier working space 110, an outer wall 120 remote from the drier working space 110 and thermal insulation 122 disposed between the inner wall 118 and the outer wall 120.

At the top the drier working space 110 is bounded by a drier ceiling 124 which comprises an inner wall 126 facing the drier working space 110, an outer wall 128 remote from the drier working space 110 and thermal insulation 130 disposed between the inner wall 126 and the outer wall 128.

Each of the air supply ducts 114 is divided by means of a filter wall 132 into a nozzle pre-chamber 133 facing the drier working space 110 and a pressure duct 134 remote from the drier working space 110.

Each of the filter walls 132 has substantially rectangular filter openings 136 which are closed by filter cartridges 138 which comprise a substantially rectangular frame with a stretched filter material.

Supply nozzles 140 are disposed in the lateral boundary walls 112 of the drier working space 110, through which nozzles hot supply air can flow out of the nozzle pre-chambers 133 into the drier working space 110 in order to apply the hot supply air to the vehicle bodies 102 conveyed through the drier working space 110.

The pressure duct 134 of each of the supply air ducts 114 is connected to an air supply shaft (not shown).

Air outlet openings (not shown) are provided in the floor area of the drier working space 110, through which openings the drier working space 110 is connected to an air extraction shaft (not shown).

The air extraction shaft is connected to the air supply shaft by way of a filter unit, a heat exchanger and a fan, so that a recirculating air stream can be produced which returns from the drier working space 110 through the air extraction shaft, the filter unit, the heat exchanger, the fan, the air supply shaft and the air supply ducts 114 to the drier working space 110, the air which is recirculated by means of the fan being cleaned by the filter unit and heated by the heat exchanger.

Each of the air supply ducts 114 is bounded at the bottom by a supply duct floor 142, at the top by a supply duct ceiling 144 and on its side remote from the drier working space 110 by a side wall 146 connecting the supply duct floor 142 to the supply duct ceiling 144, wherein the supply duct floor 142, the supply duct ceiling 144 and the supply duct side wall 146 in each case comprise an inner wall 148 facing the interior space of the air supply duct 114, an outer wall 150 remote from the interior space of the air supply duct 114 and thermal insulation 152 disposed between the inner wall 148 and the outer wall 150.

The hot air drier 100 is composed of a plurality of drier segments 154 which follow one another along the conveying direction 106 and of which each drier segment 154 is formed by two drier modules 156*a*, 156*b* disposed opposite one another.

The first drier module 156*a* of a drier module pair comprises a section of an air supply duct 114 which is bounded by a supply duct floor 142, a supply duct side wall 146, a supply duct ceiling 144 and a lateral boundary wall 112.

Figure 3:
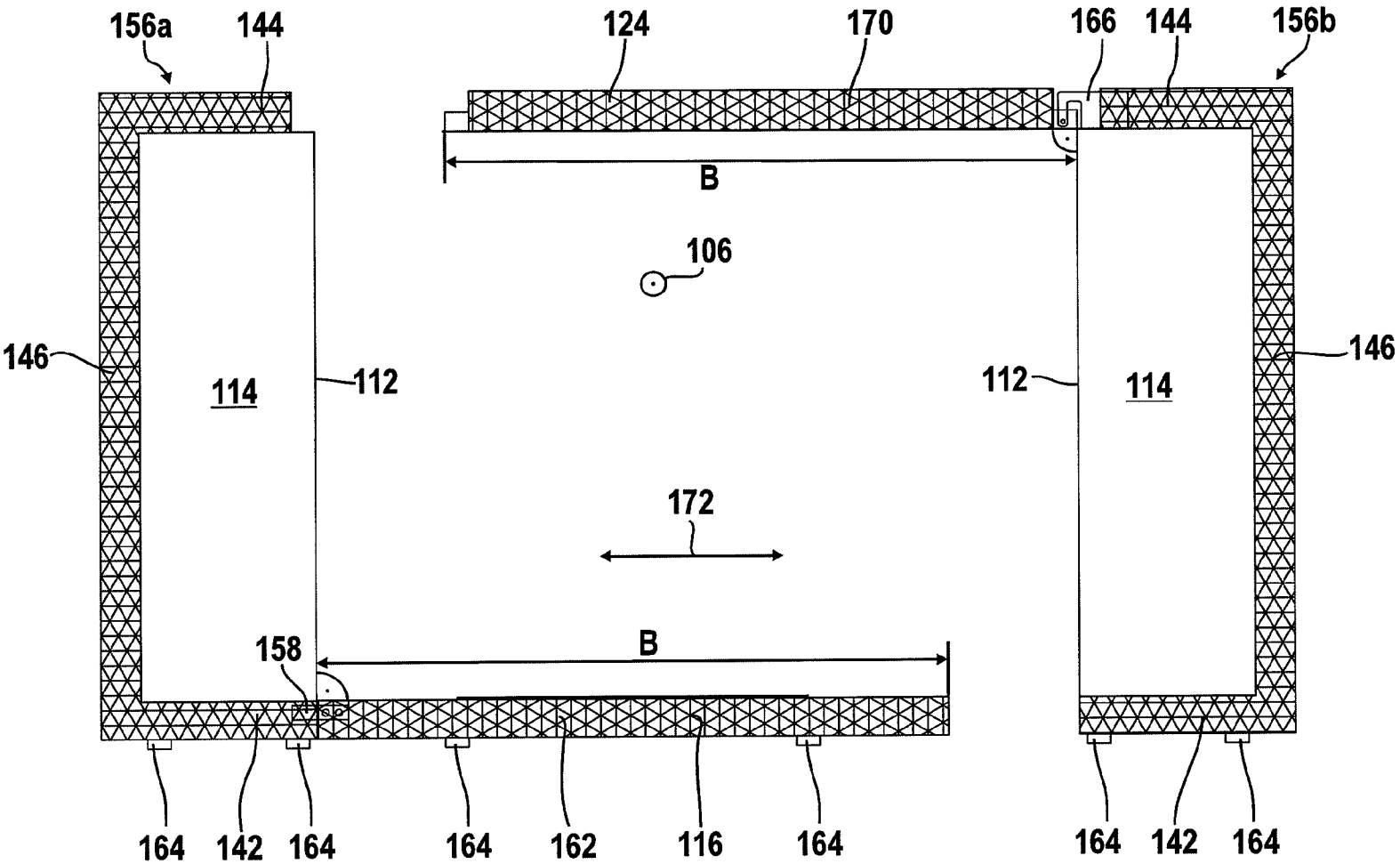
FIG. 3 is a schematic vertical section through two drier modules which are disposed opposite one another and are both in an unfolded state.
Figure 4:
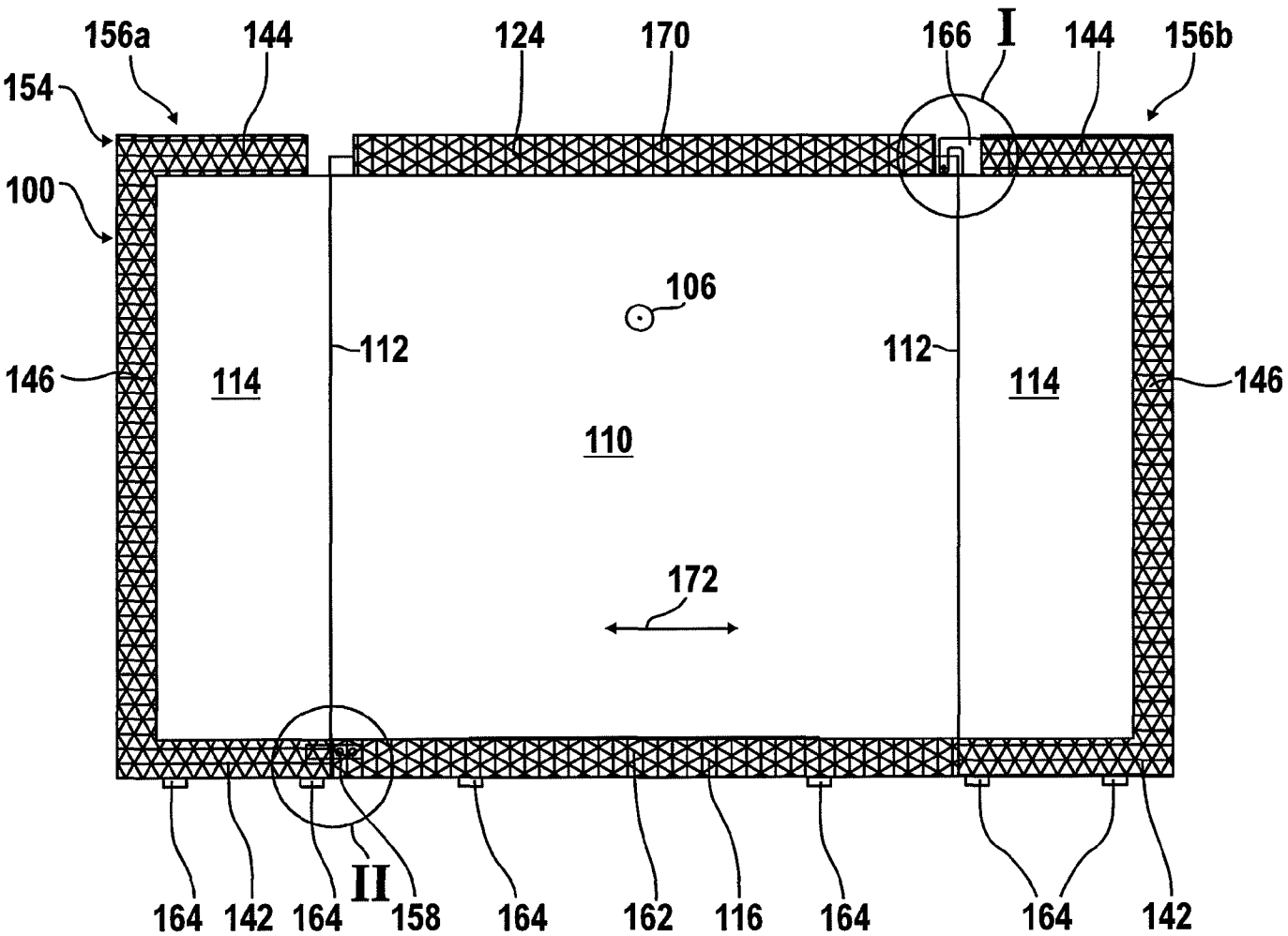
FIG. 4 is a schematic vertical section through a segment of a hot air drier which is composed of two drier modules in the unfolded state.
Figure 6:
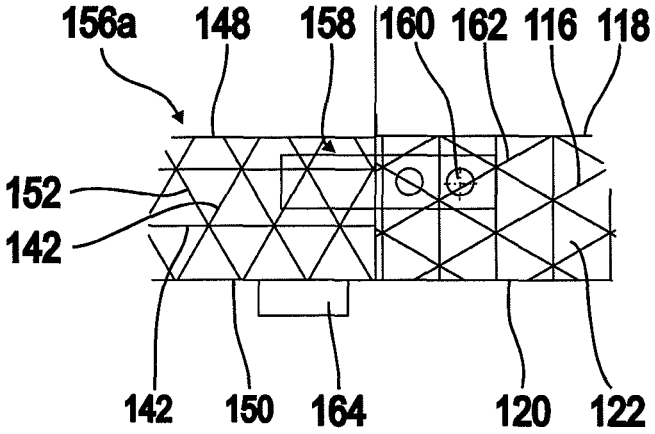
FIG. 6 is an enlarged representation of the area II from FIG. 4.

The first drier module 156*a* also comprises a section 162 of the drier floor 116 which extends over the entire width B of the drier floor 116, i.e. its extent perpendicularly to the conveying direction 106, and is held at the supply duct floor 142 of the first drier module 156*a* so as to be pivotable about a pivot axis 160 extending horizontally and parallel to the conveying direction 106 by means of one or more successive hinges 158 in the conveying direction 106 (see FIGS. 3, 4 and 6).

In FIG. 3 the first drier module 156*a* is shown in an unfolded state, in which the drier floor section 162 is oriented horizontally and parallel to the supply duct floor 142 of the first drier module 156*a* and substantially perpendicularly to the lateral boundary wall 112 of the first drier module 156*a*.

In this unfolded state the drier floor section 162 and the supply duct floor 142 of the first drier module 156*a* are supported by means of support feet 164 on a base of the hot air drier 100.

Figure 5:
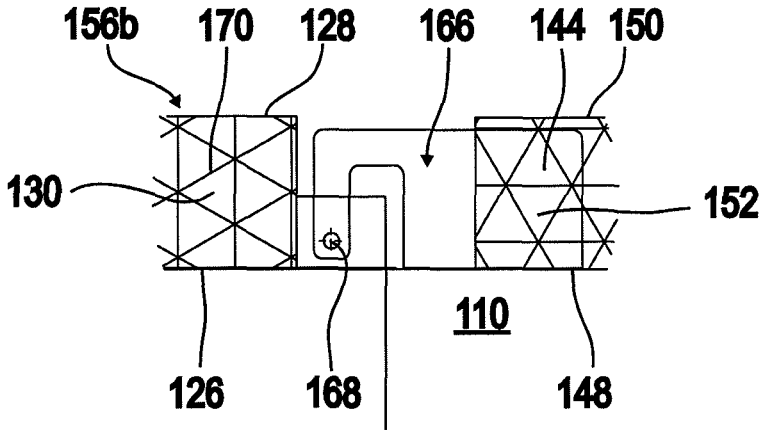
FIG. 5 is an enlarged representation of the area I from FIG. 4.

The second drier module 156*b* comprises a segment of the second air supply duct 114 which is bounded by a supply duct floor 142, a supply duct side wall 146, a supply duct ceiling 144 and a lateral boundary wall 112, as well as a section 170 of the drier ceiling 124 which extends over substantially the entire width B of the drier ceiling 124 and is held on the supply duct ceiling 144 of the second drier module 156*b* so as to be pivotable about a pivot axis 168 extending horizontally and parallel to the conveying direction 106 by means of one or more successive hinges 166 along the conveying direction 106 (see FIGS. 3 to 5).

In the unfolded state of the second drier module 156*b* which is shown in FIG. 3 the drier ceiling section 170 of the second drier module 156*b* is oriented substantially horizontally and parallel to the supply duct ceiling 144 of the second drier module 156*b* and substantially perpendicularly to the lateral boundary wall 112 of the second drier module 156*b*.

In this state the supply duct floor 142 of the second drier module 156*b* is supported with support feet 164 on a base of the hot air drier 100.

A drier segment 154 of the hot air drier 100 is produced from the first drier module 156*a* and the second drier module 156*b* by placing the two drier modules 156*a* and 156*b* opposite one another in the unfolded state, so that they are aligned with one another in a horizontal transverse direction 172 extending perpendicularly to the conveying direction 106, and then pushing them together along this transverse direction 172 extending perpendicularly to the conveying direction 106 and horizontally until the drier floor section 172 of the first drier module 156*a* abuts against the supply duct floor 142 of the second drier module 156*b* and the free edge of the drier ceiling section 170 of the second drier module 156*b* abuts against the supply duct ceiling 144 of the first drier module 156*a*, as is shown in FIG. 4.

In this position the two drier modules 156*a*, 156*b* are welded together in a substantially gastight manner along a first weld line 174 which extends along the free edge of the drier floor section 162 of the first drier module 156*a* and the free edge of the supply duct floor 142 of the second drier module 156*b*, and by means of a second weld line 176 which extends along the free edge of the drier ceiling section 170 of the second drier module 156*b* and the free edge of the supply duct ceiling 144 of the first drier module 156*a*.

Furthermore, the first drier module 156*a* is fixed and stabilised in the unfolded position by welding the drier floor section 162 and the supply duct floor 142 of the first drier module 156*a* together in a substantially gastight manner along a third weld line 178.

The second drier module 156*b* is accordingly fixed and stabilised in the unfolded state by welding the drier ceiling section 170 and the supply duct ceiling 144 of the second drier module 156*b* together in a substantially gastight manner along a fourth weld line 180.

Metallic profile elements extending along the conveying direction 106 can be disposed in the area of the weld lines 174, 176, 178 and 180 for reinforcement and improved sealing, which elements are in each case welded to the first drier module 156*a* and/or to the second drier module 156*b*.

Figure 2:
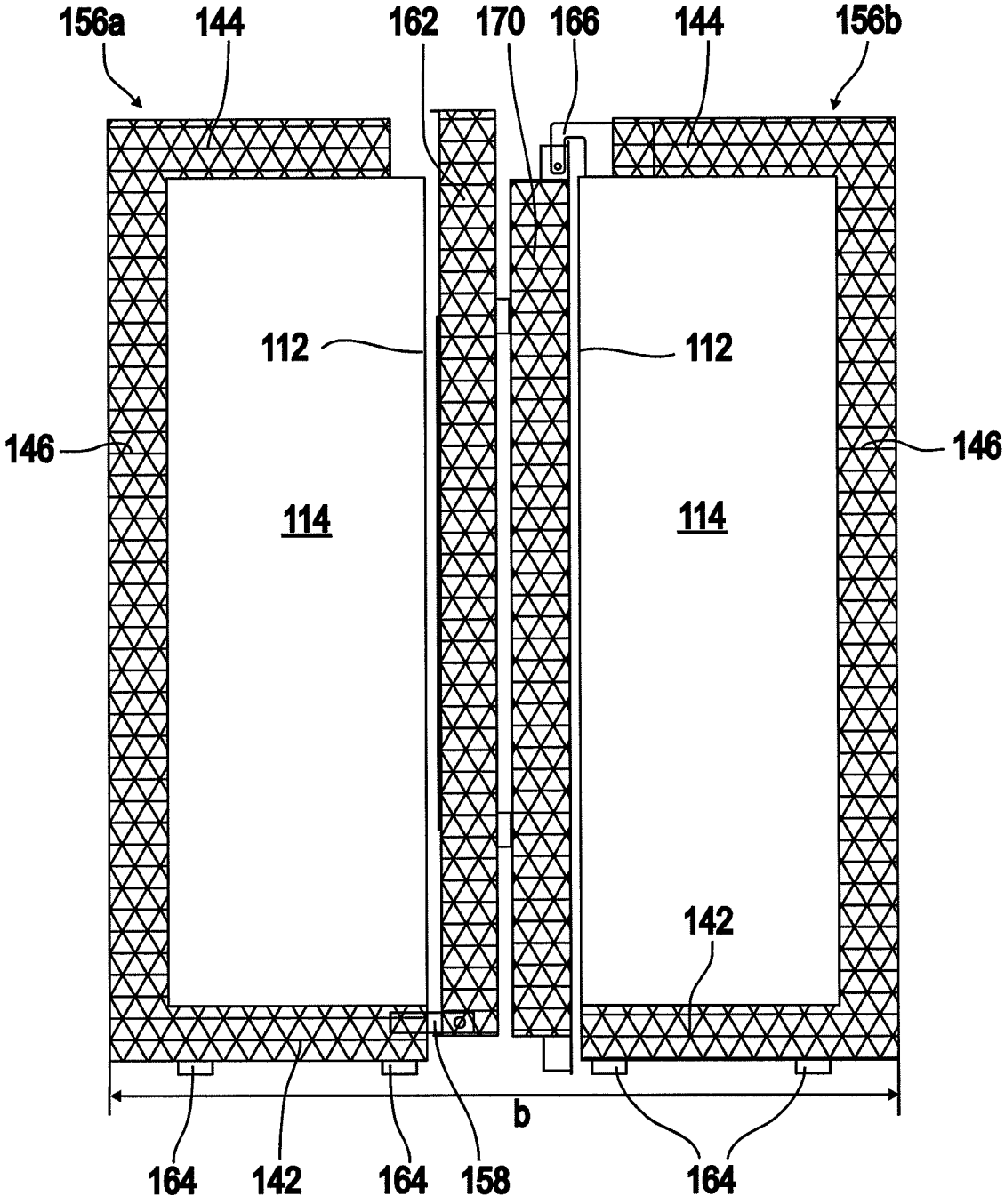
FIG. 2 is a schematic section through two drier modules which are both in the folded state.

The drier modules 156*a*, 156*b* are transported from their production site to the erection site of the hot air drier 100 in the folded state which is shown in FIG. 2 and in which the drier floor section 162 of the first drier module 156*a* is pivoted through 90° about the pivot axis 160 relative to its position in the unfolded state so that it extends substantially vertically and substantially parallel to the lateral boundary wall 112 of the first drier module 156*a*, and in which the drier ceiling section 170 of the second drier module 156*b* is pivoted through 90° about the pivot axis 168 with respect to its position in the unfolded state so that it extends substantially vertically and substantially parallel to the lateral boundary wall 112 of the second drier module 156*b*.

When the two drier modules 156*a*, 156*b* are in this folded state the two drier modules 156*a*, 156*b* can be placed against one another so that the drier floor section 162 of the first drier module 156*a* abuts with its support feet 164 against the outside of the drier ceiling section 170 of the second drier module 156*b* and both drier modules 156*a*, 156*b* together only take up a small floor space whose width b, i.e. whose extent perpendicularly to the conveying direction 106, is only slightly greater than the width of the two air supply ducts 114 (see FIG. 2).

Figure 1:
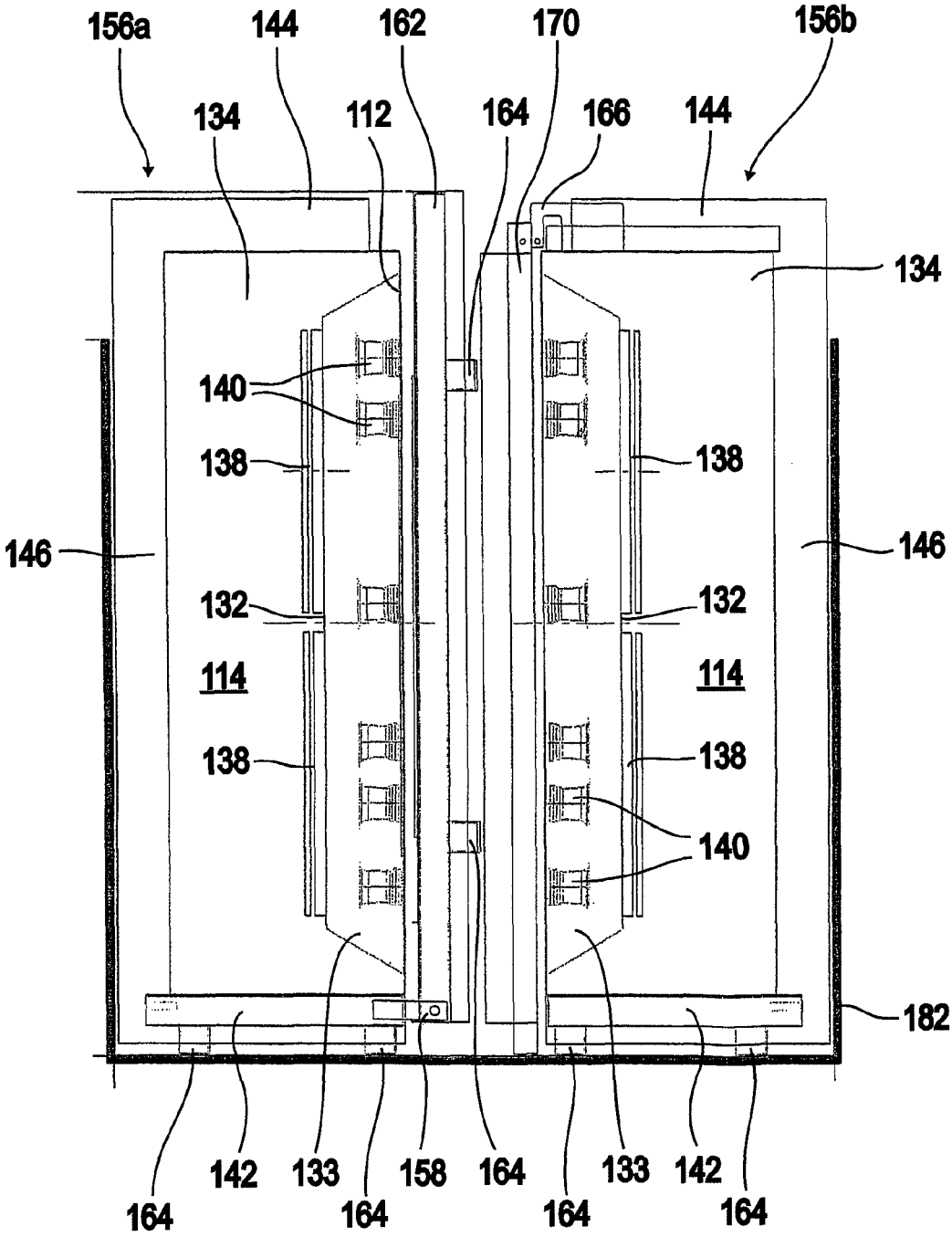
FIG. 1 is a schematic cross section through a transport container with two drier modules held therein, these both being in a folded state.

The two drier modules 156*a*, 156*b* can therefore be accommodated and transported together in a very space-saving manner in a transport container 182 in this folded state (see FIG. 1).

The transport costs for transporting the drier components from their production site to the erection site of the hot air drier 100 are as a result substantially reduced.

Furthermore, by using the drier modules 156*a*, 156*b*, the time for assembling the hot air drier 100 is distinctly reduced with respect to the conventional segmental construction, as the boundary walls of the air supply ducts 114 are already connected to a respective drier floor section 162 or to a drier ceiling section 170.

The invention claim is:

1. Drier for a coating plant, which comprises a drier working space for receiving the objects to be dried, wherein the drier working space is bounded by a drier floor, a drier ceiling and at least one lateral boundary wall, wherein the drier comprises a first drier module and a second drier module which together form a drier segment delineating the drier working space and extending in a longitudinal direction of the drier, wherein the first and second drier modules each comprise at least one section of the lateral boundary wall and at least one of a section of the drier floor and a section of the drier ceiling, wherein at least one of the drier floor section and the drier ceiling section is connected to the respective boundary wall section so as to be pivotable relative to the boundary wall section, wherein the drier floor section and the drier ceiling section extend over substantially the entire width of the drier working space, wherein the first drier module and the second drier module are welded together in a substantially gastight manner along a first weld line extending along a free edge of the drier floor section and along a second weld line extending along a free edge of the drier ceiling section, wherein the first and second drier modules are drier modules for a hot air drier, wherein the hot air drier comprises two air supply ducts through which drier supply air to be supplied to the drier working space can flow, wherein the first drier module comprises a section of a lateral boundary wall of the drier working space, a section of the drier floor, a section of an air supply duct floor, a section of an air supply duct side wall and a section of an air supply duct ceiling, wherein the drier floor section of the first drier module is pivotably connected to the air supply duct floor section of the first drier module, and wherein the second drier module comprises a section of a lateral boundary wall of the drier working space, a section of the drier ceiling, a section of an air supply duct floor, a section of an air supply duct side wall and a section of an air supply duct ceiling, wherein the drier ceiling section of the second drier module is pivotably connected to the air supply duct ceiling section of the second drier module.

2. Drier according to claim 1 wherein at least one of the drier floor section and the drier ceiling section is connected to the respective boundary wall section by means of at least one hinge.

3. Drier according to claim 1, wherein at least one of the first and second drier modules can be brought into a folded state, in which at least one of the drier floor section and the drier ceiling section extends substantially parallel to the respective boundary wall section of the respective drier module.

4. Drier according to claim 1, wherein at least one of the drier floor section of the first drier module is fixed to the second drier module and the drier ceiling section of the second drier module is fixed to the first drier module.

5. Drier according to claim 1, wherein the first drier module has a drier floor section which is fixed to the floor of an air supply duct section of the second drier module.

6. Drier according to claim 1, wherein the second drier module has a drier ceiling section which is fixed to a ceiling of an air supply duct section of the first drier module.

7. Drier according to claim 1, wherein the drier has a plurality of drier segments which follow one another in the longitudinal direction of the drier and are in each case composed of at least two drier modules.

8. Drier according to claim 1, wherein the drier comprises a conveyor device for conveying the objects to be dried along a conveying direction through the drier working space.

9. Drier according to claim 1, wherein the drier is configured for drying vehicle bodies.

10. Drier according to claim 4, wherein at least one of the drier floor section of the first drier module is fixed to the second drier module in a substantially gastight manner and the drier ceiling section of the second drier module is fixed to the first drier module in a substantially gastight manner.

11. Drier according to claim 5, wherein the drier floor section is fixed to the floor of the air supply duct section of the second drier module in a substantially gastight manner.

12. Drier according to claim 6, wherein the drier ceiling section is fixed to the ceiling of the supply duct section of the first drier module in a substantially gastight manner.

* * * * *